US006518929B1

(12) United States Patent
Gilmore

(10) Patent No.: US 6,518,929 B1
(45) Date of Patent: Feb. 11, 2003

(54) ANTENNA POLARIZATION SEPARATION TO PROVIDE SIGNAL ISOLATION

(75) Inventor: Robert P. Gilmore, Poway, CA (US)

(73) Assignee: Mobilian Corporation, Hillsboro, OR (US)

( * ) Notice: Subject to any disclaimer, the term of this patent is extended or adjusted under 35 U.S.C. 154(b) by 0 days.

(21) Appl. No.: 09/692,909

(22) Filed: Oct. 19, 2000

(51) Int. Cl.[7] ..... H01Q 1/38
(52) U.S. Cl. ..... 343/725; 343/700 MS
(58) Field of Search ..... 343/725, 700 MS, 343/702, 829, 846, 848; 333/135

(56) References Cited

U.S. PATENT DOCUMENTS 4,903,033 A * 2/1990 Tsao et al. ..... 343/700 MS
5,045,862 A * 9/1991 Alden et al. ..... 343/700 MS
5,216,430 A * 6/1993 Rahm et al. ..... 343/700 MS
5,223,848 A * 6/1993 Rammos et al. ..... 343/700 MS
5,760,747 A * 6/1998 McCoy et al. ..... 343/728
5,907,305 A * 5/1999 Epp et al. ..... 343/700 MS
5,923,229 A * 7/1999 Simons ..... 333/135
5,949,376 A * 9/1999 McDonald et al. .. 343/700 MS
5,990,835 A * 11/1999 Kuntzsch et al. .... 343/700 MS
5,995,052 A * 11/1999 Sadler et al. ..... 343/702
6,054,961 A * 4/2000 Gong et al. ..... 343/713

* cited by examiner

*Primary Examiner*—Don Wong
*Assistant Examiner*—James Clinger
(74) *Attorney, Agent, or Firm*—Cooley Godward LLP

(57) ABSTRACT

A first antenna component has a first polarization. A second antenna component has a second polarization. The second polarization is distinct from the first polarization to provide signal isolation between the first antenna component and the second antenna component. The first antenna component and the second antenna component are coupled in close proximity in a single form factor.

42 Claims, 8 Drawing Sheets

ANTENNA POLARIZATION SEPARATION TO PROVIDE SIGNAL ISOLATION

FIELD OF THE INVENTION

The present invention pertains to the field of wireless communications. More particularly, this invention relates to polarization separation to provide signal isolation among antennas in close proximity.

BACKGROUND

Wireless communications offer increased convenience, versatility, and mobility compared to wireline alternatives. Cellular phones, wireless computer networking, and wireless peripheral components, such as a mouse, headphones, and keyboard, are but a few examples of how wireless communications have permeated daily life. Countless additional wireless technologies and applications are likely to be developed in the years to come.

Wireless communications use various forms of signals, such as radio frequency (RF) signals, to transmit data. A transmitter broadcasts a signal from an antenna in a particular frequency band. As the signal travels, the signal loses power or attenuates. The farther the signal travels, the more the signal attenuates.

The signal also encounters various forms of interference along the way that introduce noise in the signal. The transmitter itself introduces noise. Signals from other transmitters also introduce noise. A receiver trying to receive the signal is likely to introduce a comparative large amount of noise. Virtually anything can cause noise, including the ground, the sky, the sun, and just about any animate or inanimate object.

At some distance from the transmitter, the signal will attenuate to the point that it becomes lost in noise. When noise overpowers a signal, the signal and the data it is carrying are often unrecoverable. That is, depending on the distance a signal travels and the amount of noise mixed with the signal, a receiver may or may not be able to recover the signal.

Of particular concern is noise introduced in a receiver by a transmitter that is located in close proximity. The noise is called a coupled signal. A coupled signal may introduce so much noise that the receiver cannot receive any other signals. Signal coupling is a major obstacle in wireless communications.

One approach used to improve reception is called antenna diversity. Using antenna diversity, a receiver receives and combines input from two antennas. The antennas are "diverse" in that they are separated by a certain distance and/or have different polarizations so that the noise received at one antenna is substantially uncorrelated to the noise received at the other antenna. A signal from a transmitter, however, is often substantially correlated at both antennas. By combining the inputs from the two antennas, the substantially correlated signals add and the substantially uncorrelated noise partially adds and partially subtracts. Consequently, the combined signal can nearly double while the combined noise will generally only increase by about half. Doubling the signal while only increasing the noise by half can substantially improve reception.

One example of antenna diversity can be found in antenna towers used for cellular telephone networks. These towers typically include one transmitter antenna and two receiver antennas separated by several feet to provide diversity.

Known antenna diversity approaches, however, have not been applied to small wireless communications technologies currently available and being developed. The small form factors that make many of these technologies attractive simply cannot accommodate known antenna diversity approaches.

A variety of other approaches have been introduced to improve reception for smaller wireless devices; especially those that include both a transmitter and a receiver. One approach to isolating a transmitter from a receiver is half duplex communications. A half duplex device cannot simultaneously send and receive. A common example is a handheld, two-way radio. When a user pushes a button to talk into the radio, the user cannot simultaneously listen to signals from other radios. That is, the receiver is disabled when the transmitter is transmitting. If the receiver were not disabled while the transmitter transmits, the transmitter would probably over power the receiver with noise.

Isolation is particularly troublesome in devices that include more than one on-board radio. For instance, a portable computer may include more than one radio to enable more than one simultaneous wireless service. A transmission from any one radio may over power receivers in multiple radios. One approach to isolating multiple transmitters from multiple receivers is time division duplex (TDD) communications. In a TDD device, all receivers are disabled when any one transmitter transmits.

A cellular phone, on the other hand, is a full duplex wireless communication device. That is, a cellular phone simultaneously transmits and receives signals so that a user can talk and listen at the same time. A cellular phone isolates its transmitter from its receiver by using two different frequency bands—one band for transmitting and one band for receiving.

None of these isolation solutions are particularly satisfying. Half duplex and TDD communications have the obvious disadvantage that a user cannot simultaneously send and receive. This poses a substantial performance limitation that will become more pronounced as more wireless communications applications and technologies are developed and adopted, and more devices include multiple on-board radios.

Full duplex communications that rely on two isolated frequency bands for sending and receiving data have the obvious disadvantage of using twice as much frequency bandwidth as half duplex communications. This poses a substantial performance limitation that will also become more pronounced as the numbers of competing wireless applications and users continues to increase, and available bandwidth continues to decrease.

BRIEF DESCRIPTION OF THE DRAWINGS

Examples of the present invention are illustrated in the accompanying drawings. The accompanying drawings, however, do not limit the scope of the present invention. Similar references in the drawings indicate similar elements.

DETAILED DESCRIPTION

Figure 1:
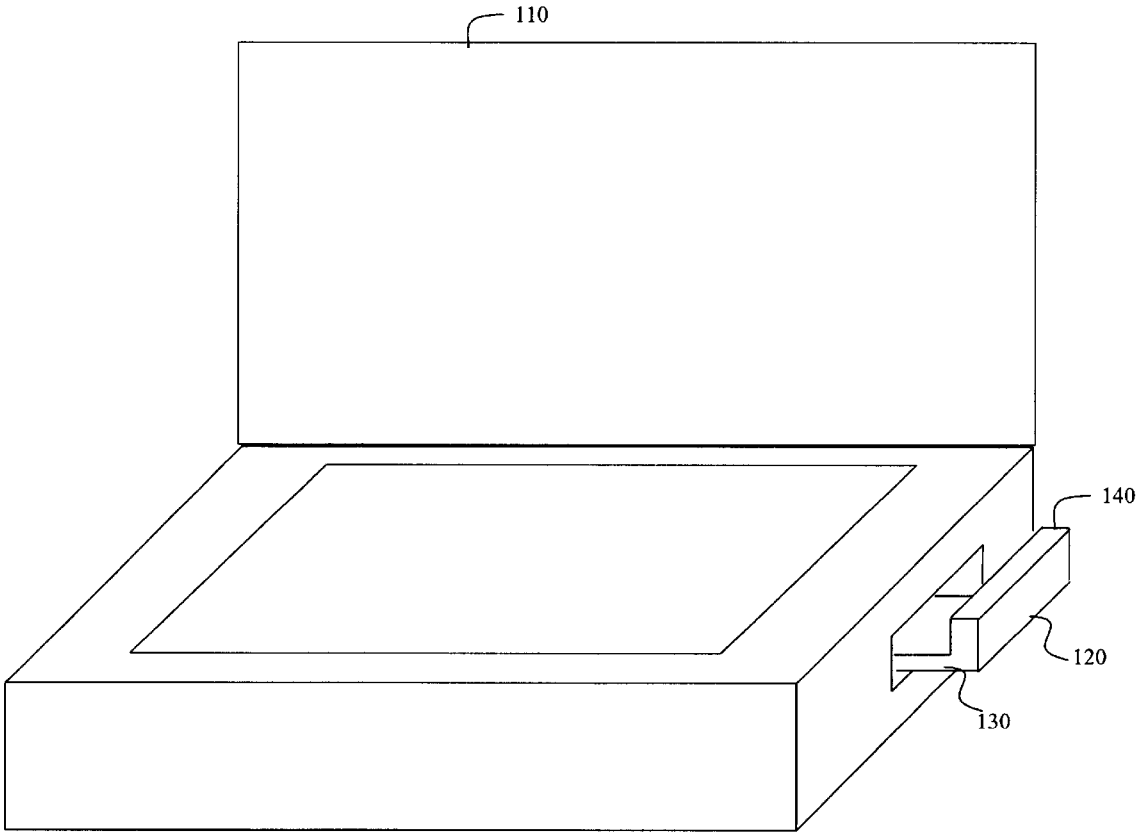
FIG. 1 illustrates one embodiment of the present invention.

In the following detailed description, numerous specific details are set forth in order to provide a thorough understanding of the present invention. However, those skilled in the art will understand that the present invention may be practiced without these specific details, that the present invention is not limited to the depicted embodiments, and that the present invention may be practiced in a variety of alternate embodiments. In other instances, well known methods, procedures, components, and circuits have not been described in detail.

Parts of the description will be presented using terminology commonly employed by those skilled in the art to convey the substance of their work to others skilled in the art. Repeated usage of the phrase "in one embodiment" does not necessarily refer to the same embodiment, although it may.

The present invention improves signal isolation among antennas, or components of one antenna, that are located in close proximity to one another. Moreover, the present invention relies on polarization separation to provide antenna diversity in smaller, more portable form factors, providing numerous improvements for wireless communications.

For example, two antennas can be used to improve reception of a single signal when the antennas have "signal isolation." That is, if two antennas receive a correlated signal and uncorrelated noise, the magnitude of the signal will increase faster than the magnitude of the uncorrelated noise when the two inputs are combined.

Alternately, two antennas can be used to receive two separate signals simultaneous when the antennas have "signal isolation." That is, a signal received at one antenna may not interfere with a signal received at the other antenna.

Similarly, two antennas can be used to improve transmission of a single signal when the antennas have "signal isolation." That is, transmitting two uncorrelated versions of the same signal tends to improve the range and quality of reception because noise that interferes with one version of the signal may not interfere with the other.

Alternately, two antennas can be used to transmit two separate signals simultaneously when the antennas have "signal isolation." That is, if the output of one antenna is uncorrelated to the output of the other antenna, separate signals can be transmitted from each antenna simultaneously without causing interference.

As another example, two antennas can be used to simultaneously transmit and receive when the antennas have "signal isolation." That is, a full duplex radio or two half duplex radios can operate simultaneously. In this last respect, the present invention provides a fundamental improvement over the prior art. For instance, where a cellular service provider has enough frequency bandwidth to serve one million prior art cellular phones using two frequency bands per phone, embodiments of the present invention may allow two million cellular phones to be served. Various embodiments of the present invention even provide signal isolation within the same frequency band, and even on a single integrated chip.

Various embodiments of the present invention discussed below can be used to implement these and various other wireless communications advantages. As illustrated in the following embodiments, polarization diversity for antennas in close proximity and small form factors can be achieved in a number of ways. In general, for polarization diversity, one antenna, or antenna component, is designed to have a horizontal polarization with respect to some reference plane. The other antenna, or antenna component, is designed to have a vertical polarization with respect to the reference plane. Vertical and horizontal polarizations are orthogonal and are therefore theoretically isolated. That is, no matter what magnitude a purely vertically polarized signal has, it will have no effect on the magnitude of a purely horizontally polarized signal.

Of course, as a practical matter, polarization separation cannot completely isolate two signals. Every antenna sends and/or receives at least some signal component in both vertical and horizontal polarizations. Therefore, as used herein, "signal isolation" actually refers to improved isolation. In practice, various embodiments of the present invention have shown substantial isolation improvement in excess of 18 dB and 27 dB of suppression.

FIG. 1 illustrates one embodiment of the present invention. Lap top computer 110 includes a PCMCIA card 120 inserted into a slot in the side of the computer. Card 120 provides one or more wireless interconnects for the computer. For instance, the card could be used to connect to a Bluetooth network, an IEEE 802.11b network, a cellular system, etc.

In order to provide the wireless interconnection(s), card 120 includes one or more antennas (not shown) arranged according to the teachings of the present invention to provide signal isolation in the small form factor of the card. The antenna may be used by one or more transmitters and/or receivers (not shown) also located on card 120 or located elsewhere in the computer 110, such as on a mother board, on another circuit card, on a configuration card, etc.

In the illustrated embodiment, the card 120 includes a horizontal portion 130 and a vertical portion 140 that extend out from the computer 110. In order to reduce interference from any metal or high dielectric materials in the computer 110, one or more antennas or antenna components can be placed in the portions of card 120 that extend from the computer. In various embodiments, the extended portions can also be used as a handle to insert or extract the circuit card.

One antenna with a linear horizontal polarization could be incorporated into the horizontal portion 130. Another antenna with a linear vertical polarization could be incorporated into the vertical portion 140. The two different polarizations could provide the signal isolation desired.

Alternately, two antennas or antenna components could be incorporated into the horizontal portion 130 alone. In which case, the vertical portion 140 may not be needed. As another alternative, two antennas or antenna components could be incorporated into the vertical portion 140. In either of these alternatives, any number of "single-plane" antenna embodiments discussed below could be used.

Figure 2:
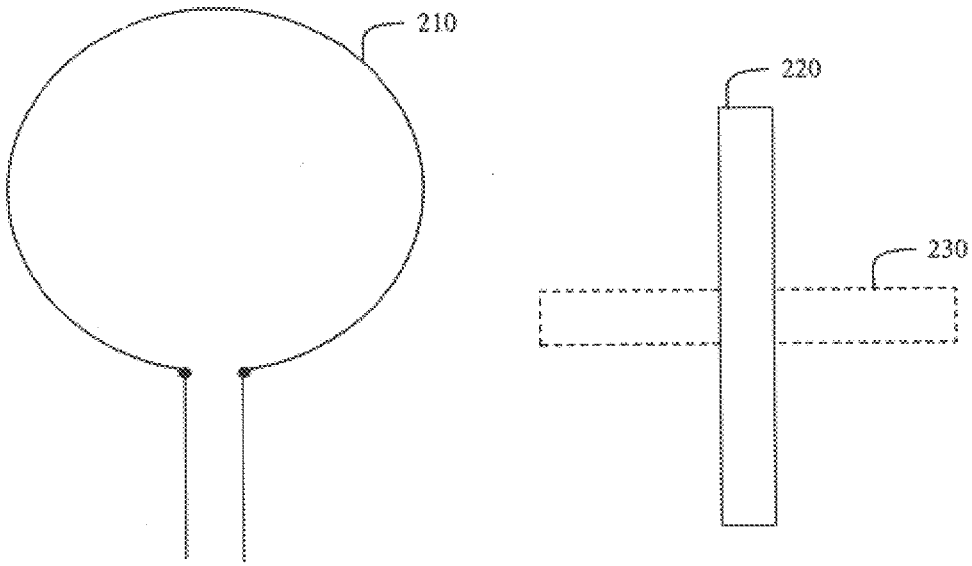
FIG. 2 illustrates one embodiment of a single-plane antenna structure.

FIG. 2 illustrates one embodiment of a single-plane antenna structure that provides the two separate polarizations needed for signal isolation. Confining the antenna structure to a single plane allows for thinner form factors. Rather than requiring a form factor sufficiently thick to incorporate different linear polarizations, polarization separation is achieved using antennas that are electric field structures adjacent to antennas that are magnetic field structures. When the two different kinds of structures are placed in the same plane, the polarizations are orthogonal and provide the desired signal isolation.

Any number of electric field structures, such as a monopole antenna, an dipole antenna, and an inverted F antenna, and any number of magnetic field structures, such as a loop antenna, a ground-plane-terminated half loop antenna, and a slot antenna, can be used. In the illustrated embodiment, loop antenna 210, when disposed on a substrate, is a magnetic field structure. In the vicinity of the antenna, a signal field from antenna 210 would propagate primarily perpendicular to the page.

Antenna 220 could be either a monopole antenna driven and/or received from one end, or a dipole antenna driven and/or received from the middle. In either case, antenna 220, when disposed on a substrate, is an electric field structure. In the vicinity of the antenna, a signal field from antenna 220 would propagate in the plane of the page. Since any signal propagated in the plane of the page would be orthogonal to the signal propagated perpendicular to the page, the electric field structure could be positioned in a variety of orientations with respect to the magnetic field structure. For instance, antenna 230 illustrates an alternate orientation for the electric field structure.

Figure 3:
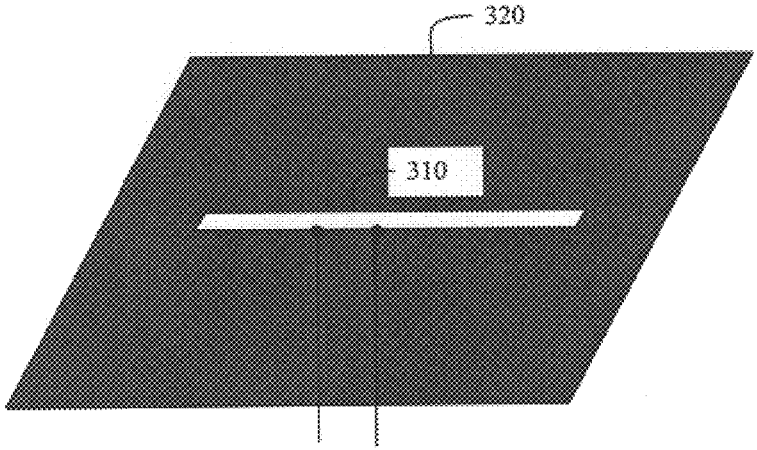
FIG. 3 illustrates one embodiment of a slot antenna.

FIG. 3 illustrates an alternate embodiment of a magnetic field structure. Rather than disposing the antenna structure on a substrate, the antenna structure is etched out of a substrate. For instance, slot 310 is etched out of ground plane 320. The slot 310 provides a dipole-like field pattern, but with the electric and magnetic fields reversed.

Figure 4:
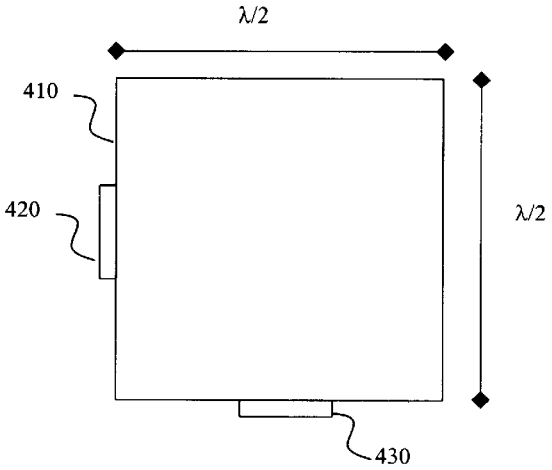
FIG. 4 illustrates one embodiment of a square patch antenna.

FIG. 4 illustrates another embodiment of a single-plane antenna structure that provides the two separate polarizations needed for signal isolation. Patch 410 is disposed on a substrate and the orthogonal polarizations are achieved by driving and/or receiving from each axis at couplers 420 and 430. Patch 410 is a single antenna structure but it embodies two antenna components. The separate antenna components can be used for all of the various advantages of signal isolation discussed above. For instance, the couplers 420 and 430 could be coupled to a single receiver, a single transmitter, two transmitters, two receiver, or a receiver and a transmitter. The dimensions of patch 410 are based on one half of the wavelength of the frequency being received or transmitted.

Figure 5:
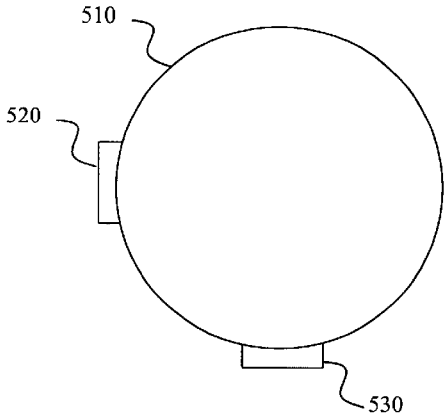
FIG. 5 illustrates one embodiment of a round patch antenna.

Patch 410 generates a circular polarization by combining the inputs or outputs from the patch. Any number of patch structures can be used that generate a circular polarization, such as a round patch, a helical patch, and parasitic patches. For instance, FIG. 5 illustrates a round patch 510 that can be driven and/or received from each axis at couplers 520 and 530 to generate a circular polarization. The diameter of patch 510 is based on one half of the wavelength.

Figure 6:
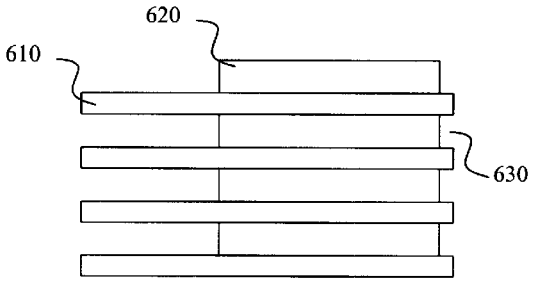
FIG. 6 illustrates one embodiment of parasitic patches.

FIG. 6 illustrates another embodiment of an antenna structure to generate a circular polarization. Patch 620 is disposed on a substrate 610 on a top layer. The bandwidth of a single patch can be increased by adding parasitic patches 630 on adjacent layers of substrate 610. Of course, adding parasitic patches increases the minimum thickness of the form factor.

Figure 7:
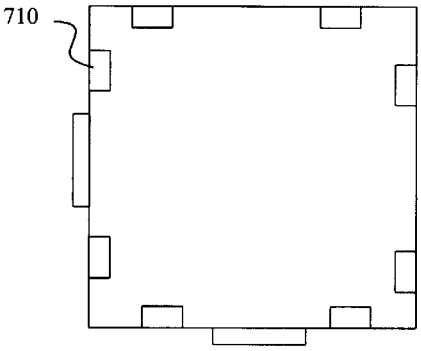
FIG. 7 illustrates one embodiment of meandering a perimeter of a patch antenna.

For various reasons, a patch may also require a certain minimum perimeter. Given a particular minimum perimeter, a patch like those discussed above may not fit within a particular form factor. For instance, if a circuit card only has available one square inch but the minimum perimeter for a patch that meets the necessary signaling requirements has an area of one and a quarter square inches, the standard patch Will not fit in the desired form factor. As illustrated in FIG. 7, in order to increase the perimeter of a patch or shrink a patch down to fit a particular form factor, the perimeter can be "meandered" to meet the necessary signal requirements. That is, notches 710 can be added to the perimeter of a patch in order to increase the length of the perimeter with respect to the overall area occupied by the patch. Similar notches can be added to other kinds of patches including round, parasitic, and helical.

Figure 8:
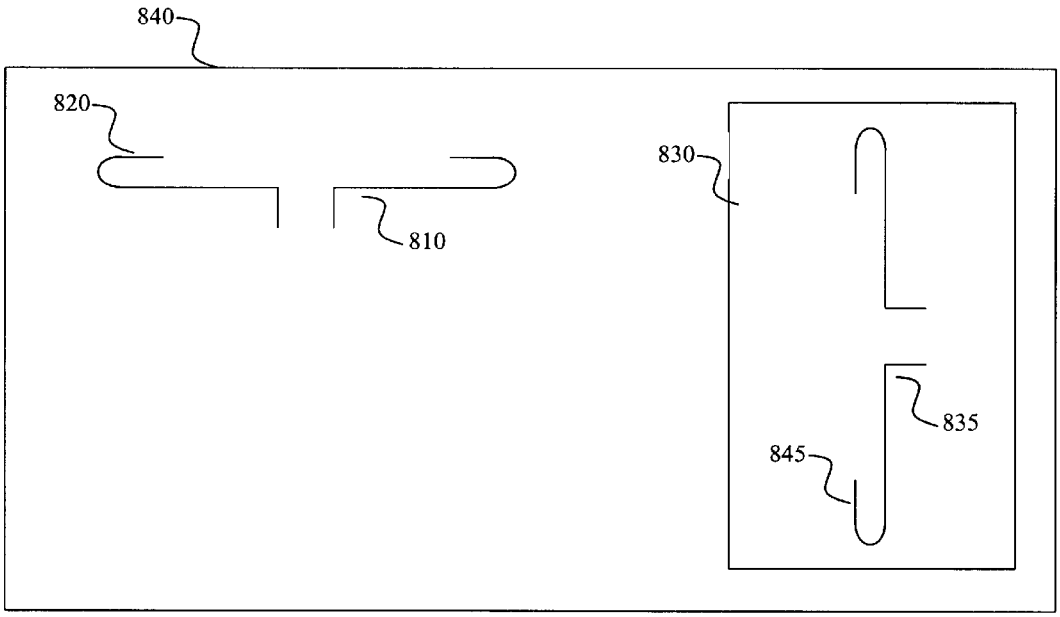
FIG. 8 illustrates one embodiment of meandering a dipole and slot antenna structure.
Figure 9:
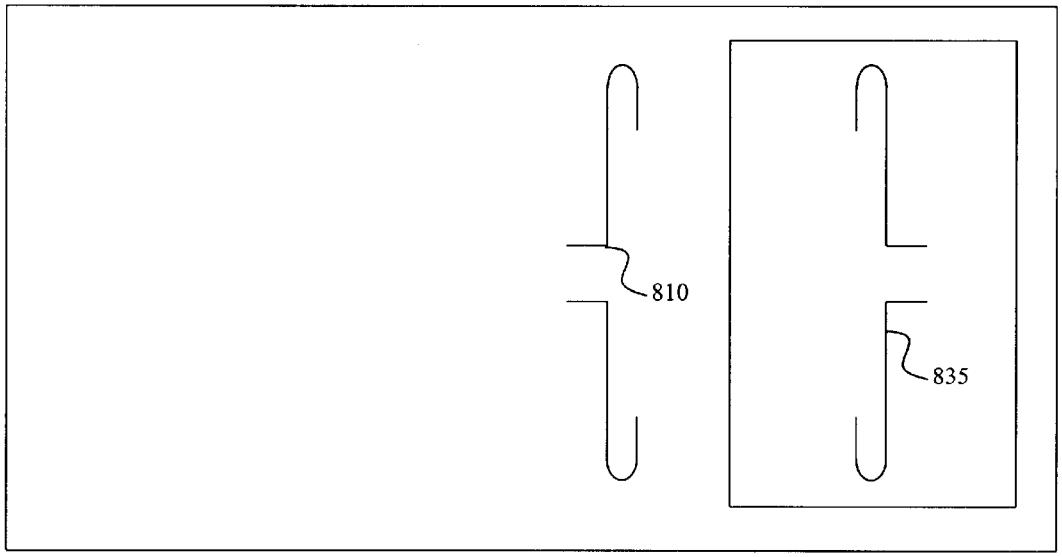
FIG. 9 illustrates another embodiment of meandering a dipole and slot antenna structure is a different orientation.

Meandering can also be applied to other antenna structures in order to fit into particular form factors. FIG. 8 illustrates a single-plane antenna structure on a substrate 840. The antenna structure includes a dipole antenna 810 and a slot antenna 835. As discussed above, slot 835 provides a polarization orthogonal to the polarization of dipole 810 so as to provide the desired signal isolation. Dipole 810 includes a meandered, or folded, portion 820 disposed at either end to fit the dipole to the available space. Slot 835 similarly includes a meandered, or folded, portion 845 etched out of ground plane 830 to fit the slot to the available space. FIG. 9 illustrates another possible orientation for the dipole 810 and the slot 835 in a single-plane antenna structure.

Figure 10:
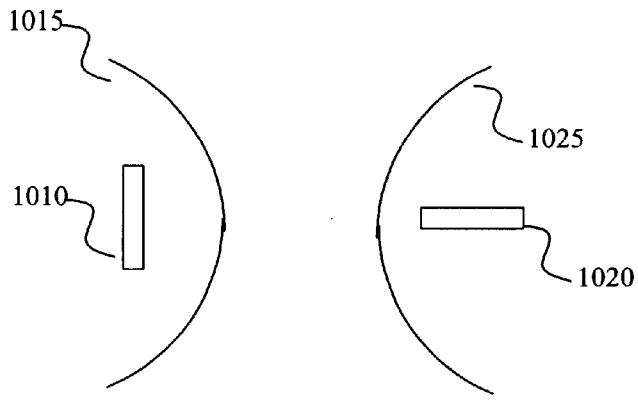
FIG. 10 illustrates one embodiment of directional polarization.

FIG. 10 illustrates a concept of directional polarization separation. Rather than providing signal isolation equally in all directions, directional polarization seeks to improve signal isolation by additionally directing radiation patterns away from adjacent antennas. For instance, in FIG. 10, antenna 1010 has a radiation pattern 1015 and antenna 1020 has a radiation pattern 1025. The intensity of the radiation is primarily focused away from the adjacent antenna to improve signal isolation. The radiation patterns are can be directed in any number of ways including orientation of the antennas and positions of ground planes between antennas. In the illustrated embodiment, antenna 1010 is a dipole and antenna 1020 is a slot. Of course, directional polarization may increase isolation at the expense of some antenna omni-directionality.

Figure 11:
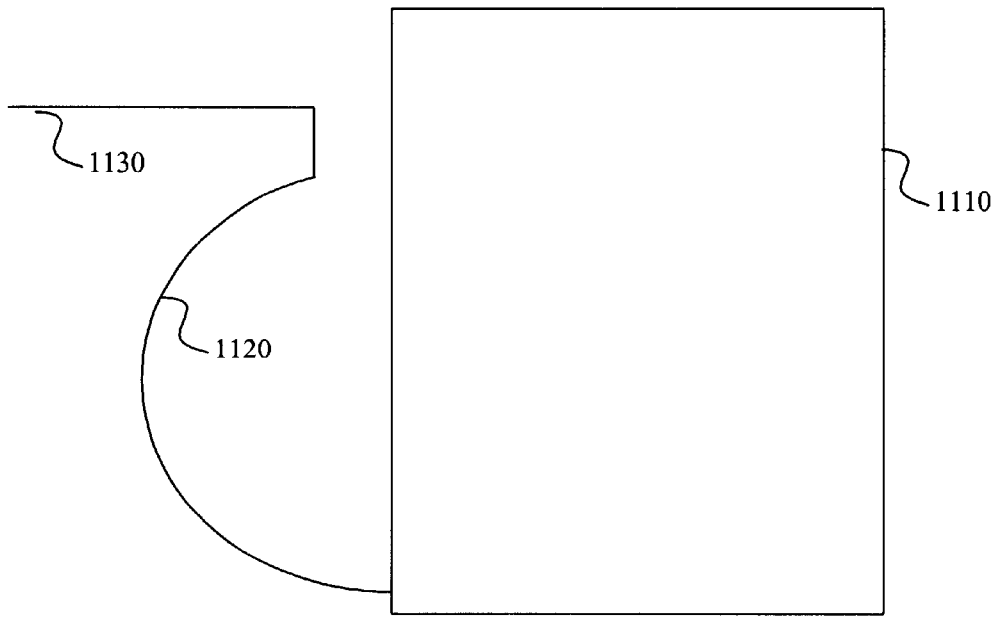
FIG. 11 illustrates one embodiment of a half-loop antenna.

FIG. 11 illustrates one embodiment of a magnetic field structure. The antenna includes a half-loop 1120 that is terminated in a ground plane 1110. One advantage of a half-loop is that it only requires one driver 1130. In various embodiments, the ground plane 1110 may also provide some directionality away from the ground plane for purposes of directional polarization.

Figure 12:
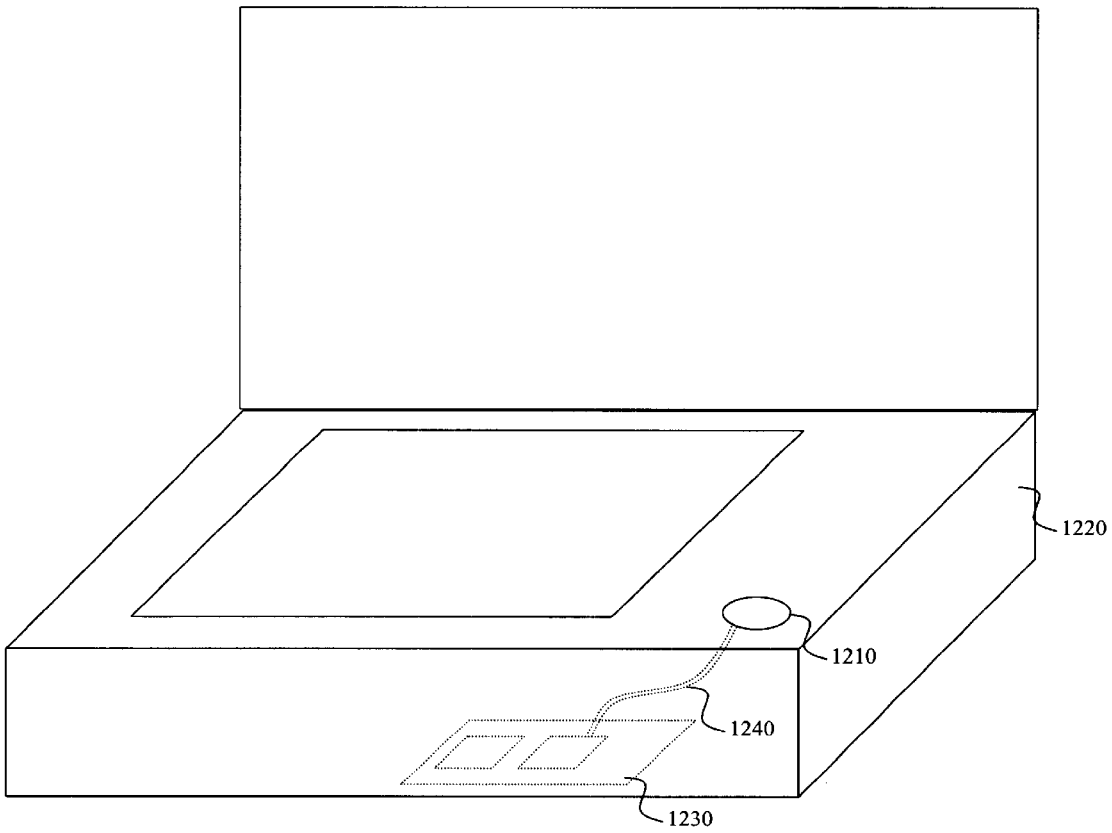
FIG. 12 illustrates another embodiment of the present invention.

FIG. 12 illustrates another embodiment of the present invention. Rather than incorporating the antenna structure 1210 on a circuit card, the antenna structure is placed on a chassis of a lap top computer 1220. The antenna structure may be surface mounted or located just below the surface of the laptop housing. The antenna structure is coupled to a chip set 1230 by a line 1240. Any number of transmission lines can be used for line 1240 including various bus structures, coaxial cable, etc. Chip set 1230 represents any of a broad category of components that can be included in a lap top computer, including the mother board, a mini-PCI card, a PCMCIA card, etc. The chip set 1230 may include one or more transmitters and/or receivers.

Of course, the present invention is not limited to use in lap top computers. The antenna structure could be incorporated into virtually any printed circuit board, integrated chip, circuit card, configuration card, desk top device, lap top device, set top box, and/or handheld device. The antenna structure performs best when it is not surrounded by metal or material having a high dielectric constant. For this reason, most of the illustrated embodiments show the antenna structure located on the chassis of a device, at or near the surface, or on some protrusion to reduce interference. In alternate embodiments however, where a host device does not contain a significant amount of metal or high dielectric materials, the antenna structure could be embedded within the host device.

Figure 13:
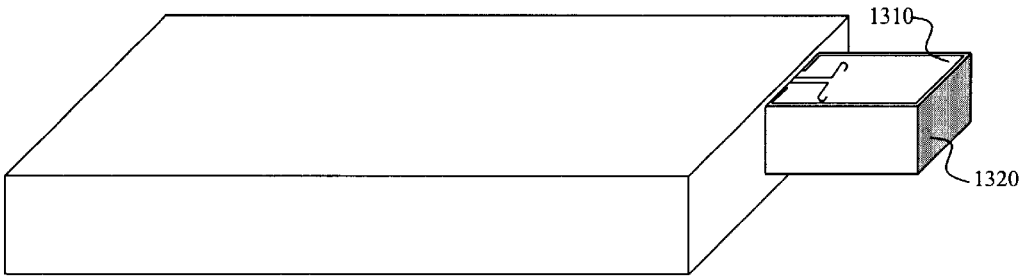
FIGS. 13 through 16 illustrate various embodiments of the present invention of a circuit card tab.
Figure 14:
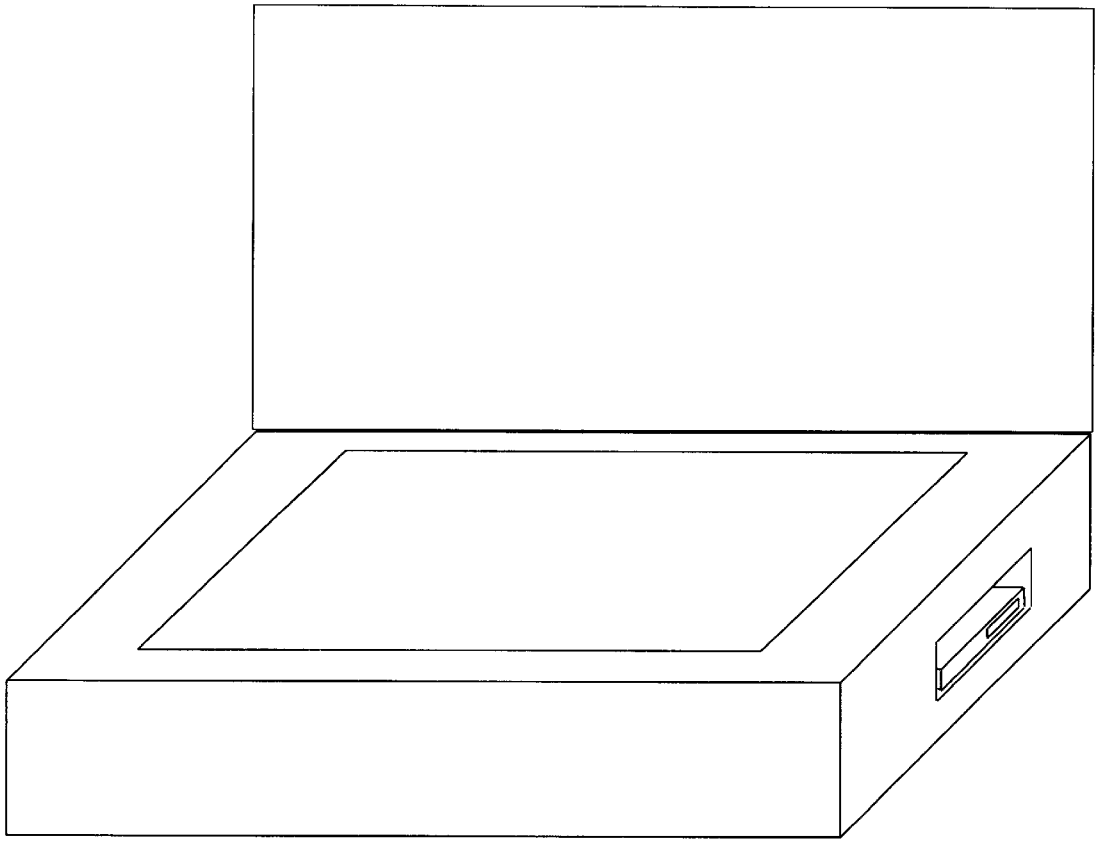

The remaining Figures illustrate embodiments of the present invention incorporated in circuit cards, such as PCMCIA cards. For instance, FIG. 13 illustrates an antenna structure 1310 on a pop-out table 1320, rather like an RJ-45 tab common on many PCMCIA cards. When the card is inserted in a computer, rather than having a "handle" permanently sticking out, the card can be fully inserted into the computer as shown in FIG. 14. Moreover, as shown in FIG. 14, the tab can be inserted into the card when the antenna structure is not in use to protect the antenna structure, the card, and the card socket from damage.

Referring back to FIG. 13, signal isolation is provided by a dipole antenna encircled by a loop antenna. In alternate embodiments, other antenna structures can be used such as a monopole and loop combination, a dipole and a slot combination, or a patch. Depending the signal requirements, certain antenna structures may not be suitable for a particular form factor. For instance, in one embodiment, the dielectric constant for the substrate of a tab has to be fairly high. The antenna structure must fit within a 0.7 inch by 0.7 inch area. Using a typical patch antenna with a high dielectric constant and small area, the required bandwidth may not be achievable without including parasitic patches. And, as discussed above, parasitic patches can make the antenna structure be too thick for the form factor. In which case, an alternate antenna structure, like the one illustrated, may provide a better solution.

Figure 15:
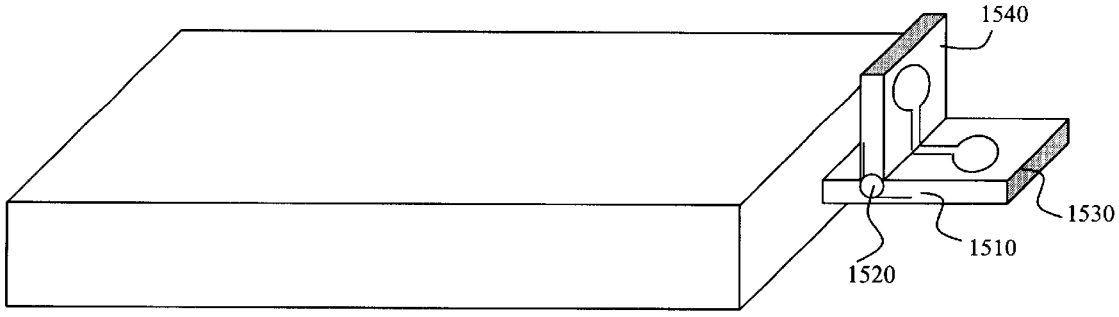

FIG. 15 illustrates another embodiment of the present invention. Pop-out tab 1530 includes a pop-up section 1540. Each section includes a separate antenna. The orthogonal orientation of the sections in the illustrated position provides the desired polarization separation. The pop-out tab 1530 also includes hinge 1520 and spring mechanism 1510. When the tab is pulled out, the pop-up section 1540 automatically pops up. When the tab is pushed in, the pop-up section 1540 automatically collapses. The two sections provide an increased surface area to mount the antenna structure. Any number of tab designs can be used to automatically collapse and extend an antenna tab so as to provide additional surface area and/or protection.

Figure 16:
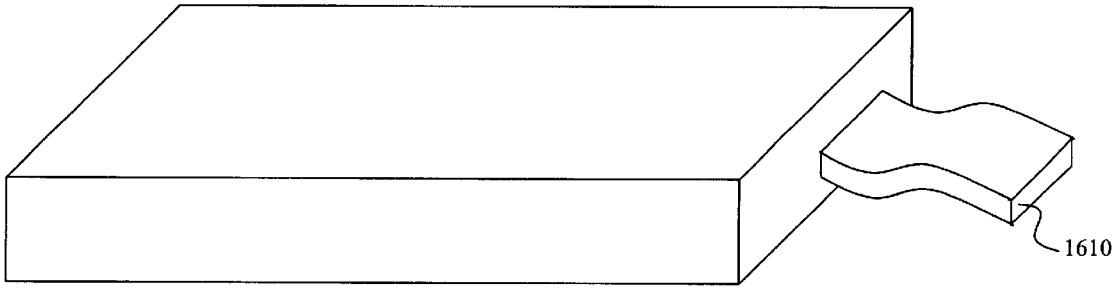

FIG. 16 illustrates yet another tab embodiment. In the illustrated embodiment, tab 1610 is made of a flexible and durable substrate material so that the tab can remain extended without worrying about accidentally breaking it off or catching it on objects. In one embodiment, the antenna structure and the flexible tab are coated with a protective sealant, such as plastic, to prevent breaks in the antennas due to scratches or the like.

Thus, antenna polarization separation to provide signal isolation is described. Whereas many alterations and modifications of the present invention will be comprehended by a person skilled in the art after having read the foregoing description, it is to be understood that the particular embodiments shown and described by way of illustration are in no way intended to be considered limiting. Therefore, references to details of particular embodiments are not intended to limit the scope of the claims.

What is claimed is:

1. An apparatus comprising:

a first antenna component disposed substantially entirely in a first plane, said first antenna component radiating energy of a first polarization from said first plane; and a second antenna component disposed substantially entirely in a second plane, said second antenna component radiating energy from said second plane in a second polarization distinct from the first polarization to provide a signal isolation between the first antenna component and the second antenna component, said first antenna component and said second antenna component coupled in close proximity in a single form factor, wherein the signal isolation comprises isolation between a first signal received in the first polarization and a second signal simultaneously transmitted in the second polarization, wherein the first signal and the second signal use a single frequency in common.

2. The apparatus of claim 1 wherein the single form factor comprises one of:

a printed circuit board, an integrated chip, a circuit card, a configuration card, a desk top device chassis, a lap top device chassis, a set top device chassis, and a hand held device chassis.

3. The apparatus of claim 1 wherein the first antenna component and the second antenna component are disposed in a single plane oriented substantially identically to said first plane and to said second plane.

4. The apparatus of claim 3 wherein the first polarization is a linear polarization vertical to the signal plane and the second polarization is a linear polarization horizontal to the single plane.

5. The apparatus of claim 1 wherein the first antenna component has an electric field structure and the second antenna component has a magnetic field structure.

6. The apparatus of claim 1 wherein the first antenna component comprises one of a dipole antenna, a monopole antenna, and an inverted F antenna, and the second antenna component comprises one of a loop antenna, a ground-plane-terminated half loop antenna, and a slot antenna.

7. The apparatus of claim 1 wherein the first antenna component is one of etched onto a substrate or etched out of a substrate.

8. The apparatus of claim 1 wherein the first antenna component and the second antenna component comprise a single patch on a substrate, said patch to be driven and/or received from two axes.

9. The apparatus of claim 8 wherein the first antenna component and the second antenna component further comprise at least one parasitic patch adjacent to the single patch on at least one additional layer of the substrate.

10. The apparatus of claim 8 wherein the single patch is one of round, square, and helical.

11. The apparatus of claim 8 wherein a perimeter of the single patch is notched.

12. The apparatus of claim 8 wherein the two axes are coupled to physically independent receivers and/or transmitters.

13. The apparatus of claim 1 wherein one or both of the first antenna component and the second antenna component are meandered.

14. The apparatus of claim 1 wherein the single form factor comprises a housing for the first antenna component and the second antenna component to provide separation from shielding material associated with the single form factor.

15. The apparatus of claim 14 wherein the position of the housing relative to the single form factor is selected from the group consisting of: a fixed position and an extendable position.

16. The apparatus of claim 14 wherein the housing is flexible.

17. The apparatus of claim 14 wherein the housing comprises:

a planar portion to extend outwardly from the single form factor and to include the first antenna component; and a vertical portion to extend substantially orthogonal to the planar portion and to include the second antenna component.

18. The apparatus of claim 17 wherein the vertical portion is mechanically coupled to automatically move to a vertical position as the housing is extended from the single form factor.

19. The apparatus of claim 17 wherein the vertical portion is mechanically coupled to automatically move to a planar position as the housing is collapsed into the single form factor.

20. The apparatus of claim 1 wherein the first antenna component and the second antenna component are to remotely coupled to at least one transmitter and/or receiver.

21. The apparatus of claim 20 wherein the single form factor comprises a host device and the first antenna component and the second antenna component are to remotely couple to the at least one transmitter and/or receiver installed within the host device.

22. The apparatus of claim 20 wherein the single form factor comprises a component to install in a host device and the first antenna component and the second antenna component are to remotely couple to the at least one transmitter and/or receiver installed elsewhere within the host device.

23. The apparatus of claim 1 wherein the first antenna component and the second antenna component are to couple to at least one transmitter and/or receiver all within the single form factor.

24. The apparatus of claim 1 wherein the first antenna component comprises a loop antenna to substantially encircle the second antenna component, said second antenna component to comprise one of a monopole antenna and a dipole antenna.

25. The apparatus of claim 1 wherein the first antenna component is to couple to a fist radio transceiver and the second antenna component is to couple to a second radio transceiver.

26. The apparatus of claim 1 wherein the first antenna component is to couple to a transmitter of a first radio and a transmitter of a second radio, and the second antenna component is to couple to a receiver of the first radio and a receiver of the second radio.

27. The apparatus of claim 1 wherein the first antenna component is to couple to a transmitter of a full duplex radio and the second antenna component is to couple to a receiver of a full duplex radio.

28. The apparatus of claim 1 wherein the first polarization is directionally polarized in a first direction toward the second antenna component and the second polarization is directionally polarized in a second direction toward the first antenna component.

29. An apparatus comprising:

a first antenna component disposed substantially entirely in a first plane, said first antenna component radiating energy of a first polarization from said first plane; and a second antenna component disposed substantially entirely in a second plane, said second antenna component radiating energy from said second plane in a second polarization distinct from the first polarization to provide a signal isolation between the first antenna component and the second antenna component, said first antenna component and said second antenna component coupled in close proximity in a single form factor, wherein the signal isolation comprises isolation between a first signal transmitted in the first polarization and a second signal simultaneously transmitted in the second polarization, wherein the first signal and the second signal use a single frequency in common.

30. An apparatus comprising:

a first antenna component disposed substantially entirely in a first plane, said first antenna component radiating energy of a first polarization from said first plane; and a second antenna component disposed substantially entirely in a second plane, said second antenna component radiating energy from said second plane in a second polarization distinct from the first polarization to provide a signal isolation between the first antenna component and the second antenna component, said first antenna component and said second antenna component coupled in close proximity in a single form factor, wherein the signal isolation comprises isolation between a first signal received in the first polarization and a second signal simultaneously received in the second polarization, wherein the first signal and the second signal use a single frequency in common.

31. The apparatus of claim 30 wherein a combination of a first signal received by the first antenna component and a second signal simultaneously received by the second antenna component provide a combined signal having an improved signal to noise ratio.

32. An apparatus comprising:

a first antenna component disposed substantially entirely in a first plane, said first antenna component radiating energy of a first polarization from said first plane; and a second antenna component disposed substantially entirely in a second plane, said second antenna component radiating energy from said second plane in a second polarization distinct from the first polarization to provide a signal isolation between the first antenna component and the second antenna component, said first antenna component and said second antenna component coupled in close proximity in a single form factor, wherein the signal isolation comprises isolation between a signal simultaneously transmitted both in the first polarization and the second polarization of a single frequency.

33. An apparatus comprising:

a first antenna component disposed substantially entirely in a first plane, said first antenna component radiating energy of a first polarization from said first plane; and a second antenna component disposed substantially entirely in a second plane, said second antenna component radiating energy from said second plane in a second polarization distinct from the first polarization to provide a signal isolation between the first antenna component and the second antenna component, said first antenna component and said second antenna component coupled in close proximity in a single form factor, wherein the signal isolation comprises isolation between a signal simultaneously received both in the first polarization and the second polarization of a single frequency.

34. An apparatus comprising:

an antenna patch element disposed in a plane;

a first coupler through which said antenna patch element may be driven along a first axis so as to induce said antenna patch element to radiate energy of a first polarization; and a second coupler through which said antenna patch element may be driven along a second axis so as to induce said antenna patch element to radiate energy of a second polarization distinct from said first polarization in order to provide signal isolation, said first and second couplers being disposed substantially in said plane.

35. The apparatus of claim 34 further comprising a first transceiver operatively coupled to said first coupler.

36. The apparatus of claim 35 further comprising a second transceiver operatively coupled to said second coupler.

37. The apparatus of claim 34 wherein said first polarization is a linear polarization oriented vertically relative to a plane of said antenna patch element and said second polarization is a linear polarization oriented horizontally relative to said plane of said antenna patch element.

38. The apparatus of claim 34 wherein said antenna patch element is disposed upon a first layer of a substrate, said apparatus further including at least one parasitic patch element adjacent to said antenna patch element on at least one additional layer of said substrate.

39. The apparatus of claim 29 wherein the first antenna component and the second antenna component are disposed in a single plane.

40. The apparatus of claim 30 wherein the first antenna component and the second antenna component are disposed in a single plane.

41. The apparatus of claim 32 wherein the first antenna component and the second antenna component are disposed in a single plane.

42. The apparatus of claim 33 wherein the first antenna component and the second antenna component are disposed in a single plane.

* * * * *